US006971728B2

(12) United States Patent
Tsai

(10) Patent No.: US 6,971,728 B2
(45) Date of Patent: Dec. 6, 2005

(54) COMBINATIVE LOCKER

(76) Inventor: Ritter Tsai, No. 31, Kuang Fu Rd., Erh Lin Town, Changhua Hsien (TW)

( * ) Notice: Subject to any disclaimer, the term of this patent is extended or adjusted under 35 U.S.C. 154(b) by 30 days.

(21) Appl. No.: 10/642,985

(22) Filed: Aug. 18, 2003

(65) Prior Publication Data

US 2005/0040742 A1 Feb. 24, 2005

(51) Int. Cl.[7] ..... A47B 47/00; B65D 6/24
(52) U.S. Cl. ..... 312/263; 312/257.1; 220/4.34
(58) Field of Search ..... 312/257.1, 258, 312/263, 265, 108; 220/4.28, 4.33, 4.34; 217/12, 43

(56) References Cited

U.S. PATENT DOCUMENTS 2,550,088 A * 4/1951 Sayer ..... 220/6
4,836,626 A * 6/1989 Taylor et al. ..... 312/257.1
4,844,566 A * 7/1989 Moore et al. ..... 312/108
6,209,976 B1 * 4/2001 Shear ..... 312/263
2002/0043905 A1 * 4/2002 Insalaco et al. ..... 312/108

FOREIGN PATENT DOCUMENTS

FR 2636921 * 3/1990

* cited by examiner

*Primary Examiner*—James O. Hansen
(74) *Attorney, Agent, or Firm*—Alan D. Kamrath; Nikolai & Mersereau, P.A.

(57) ABSTRACT

A combinative locker includes four peripheral panels, a rear panel and a front panel. The peripheral panels are connected with one another. Each of the peripheral panels includes an internal side, a rear edge, a front edge, a first reinforcement device formed on the internal side at the rear edge and a second reinforcement device formed on the internal side at the front edge. The rear panel includes a plurality of edges each connected with the rear edge of one of the peripheral panels. The front panel includes a plurality of edges, one of which is pivotally connected with the front edge of one of the peripheral panels.

5 Claims, 6 Drawing Sheets

COMBINATIVE LOCKER

FIELD OF INVENTION

The present invention relates to a combinative locker.

BACKGROUND OF INVENTION

Referring to FIGS. 7 and 8, a conventional combinative locker includes a periphery, a front panel or shutter 60 pivotally connected with the periphery and a back panel connected with the periphery. The periphery includes four peripheral panels 61 that are generally made of metal. The peripheral panels 61 are connected with one another so that the periphery can be collapsed during transportation and storage. In use, the periphery is held in shape by four L-shaped connectors 63 that are generally made of plastic. Each peripheral panel 61 includes a retroflexed edge 62 so as to define a tubular space. Each L-shaped connector 63 includes an end fit in the tubular space defined in one retroflexed edge 62 and another end fit in the tubular space defined in another retroflexed edge 62. This conventional combinative locker, however, entails some drawbacks. Firstly, the L-shaped connectors 63 provide poor rigidity to the periphery. Hence, the periphery collapses easily under a heavy load. Secondly, the retroflexed edges 62 can readily cut a user. Thirdly, one such conventional combinative locker cannot be put stably on another such conventional combinative locker because of their retroflexed edges.

The present invention is therefore intended to obviate or at least alleviate the problems encountered in the prior art.

SUMMARY OF INVENTION

It is an objective of the present invention to provide a robust combinative locker.

It is another objective of the present invention to provide a combinative locker that is safe to use.

It is another objective of the present invention to provide a combinative locker that can be stably put on another combinative locker.

According to the present invention, a combinative locker includes four peripheral panels, a rear panel and a front panel. The peripheral panels are connected with one another. Each of the peripheral panels includes an internal side, a rear edge, a front edge, a first reinforcement device formed on the internal side at the rear edge and a second reinforcement device formed on the internal side at the front edge. The rear panel includes a plurality of edges each connected with the rear edge of one of the peripheral panels. The front panel includes a plurality of edges one of which is pivotally connected with the front edge of one of the peripheral panels.

Other objectives, advantages and novel features of the invention will become more apparent from the following detailed description in conjunction with the attached drawings.

BRIEF DESCRIPTION OF DRAWINGS

The present invention will be described via detailed illustration of the preferred embodiment referring to the drawings.

FIG. 7 is a perspective view of a conventional combinative locker.

FIG. 8 is a cross-sectional partial view of the conventional combinative locker of FIG. 7.

DETAILED DESCRIPTION OF PREFERRED EMBODIMENT

Figure 1:
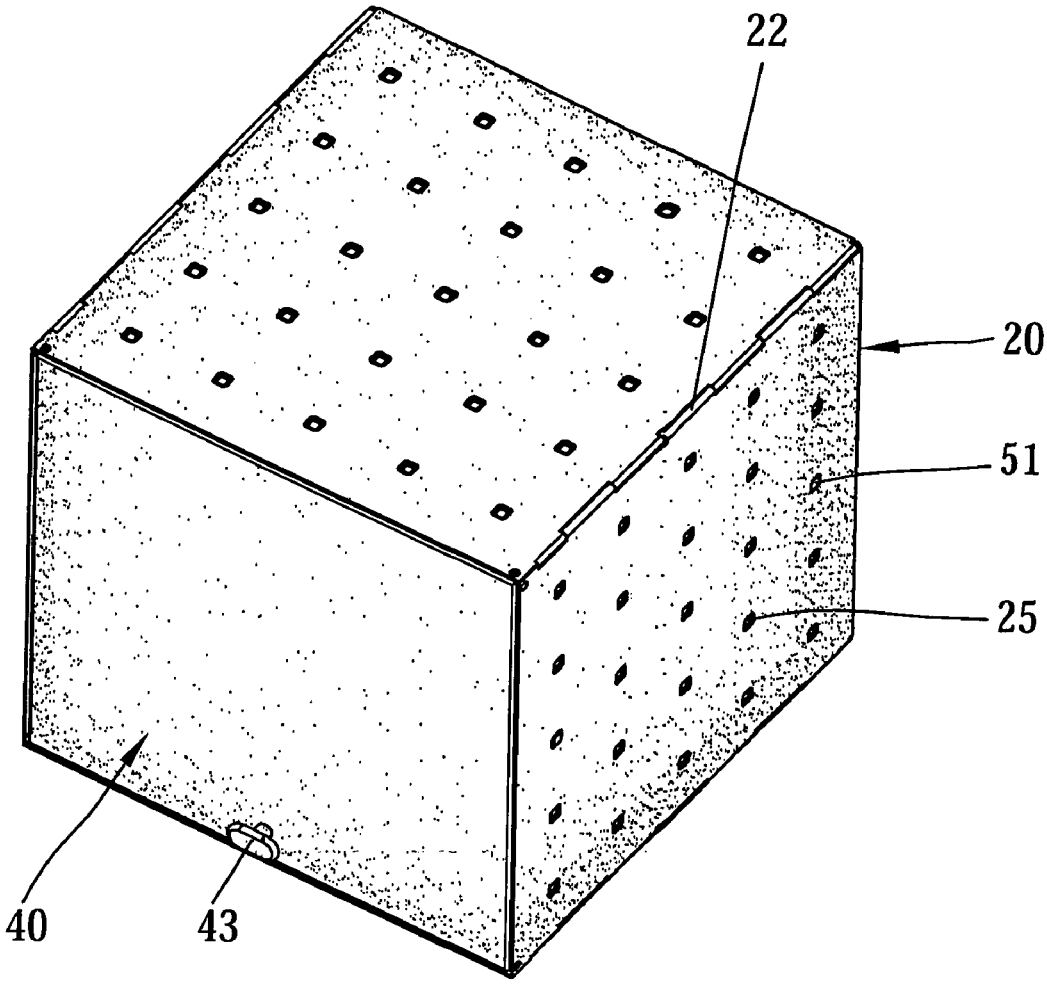
FIG. 1 is a perspective view of a combinative locker according to the present invention.
Figure 2:
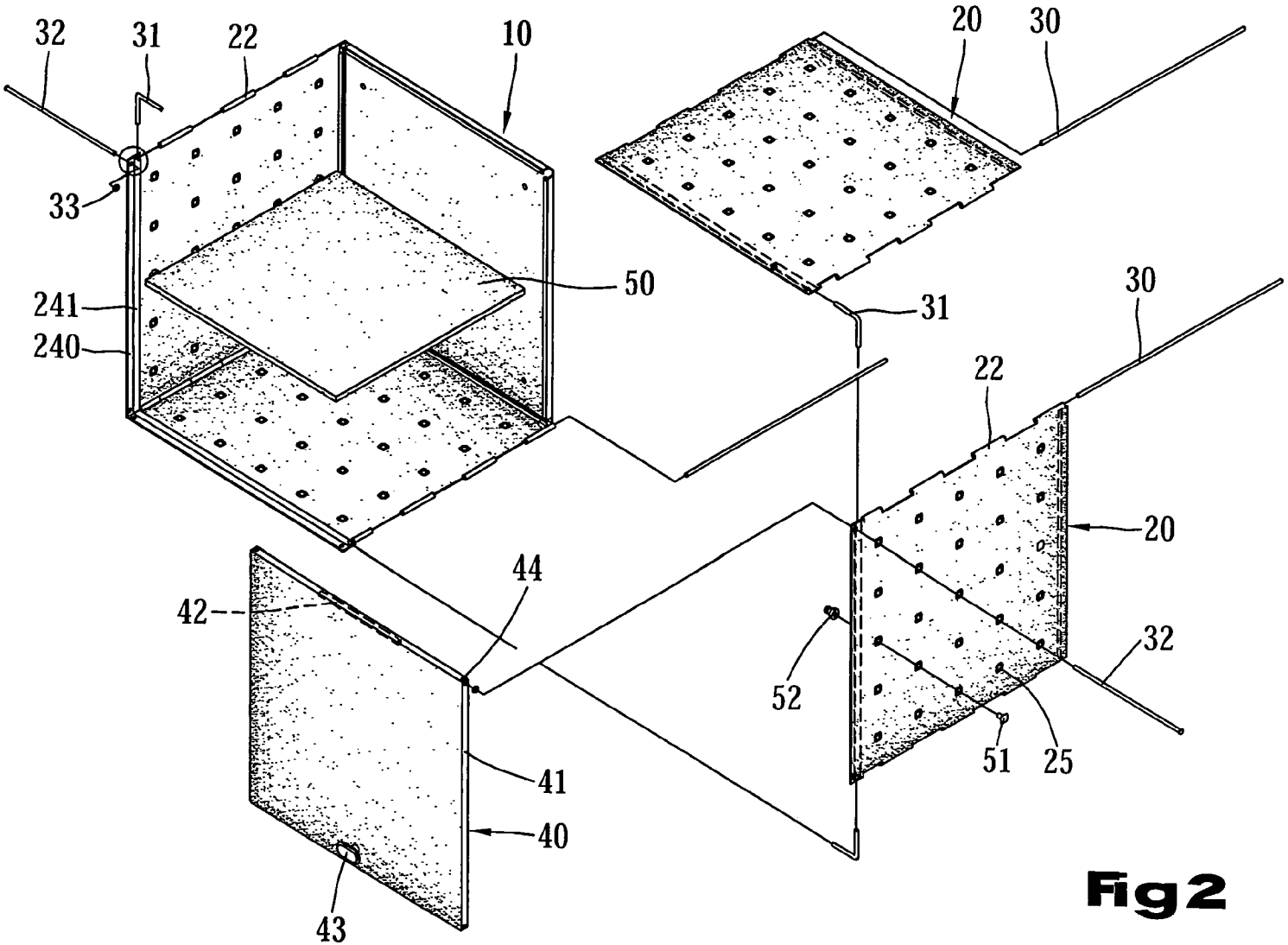
FIG. 2 is an exploded view of the combinative locker of FIG. 1.

Referring to FIGS. 1 and 2, according to the preferred embodiment of the present invention, a combinative locker includes a rear panel 10, four peripheral panels 20 and a front panel or shutter 40. The peripheral panels 20 are connected with each other. The rear panel 10 is attached to the peripheral panels 20. The shutter 40 is pivotally attached to one of the peripheral panels 20.

The rear panel 10 includes four edges. A fin 11 extends perpendicularly from each edge of the rear panel 10. Each fin 11 includes a corrugated edge that defines a groove 12.

Figure 3:
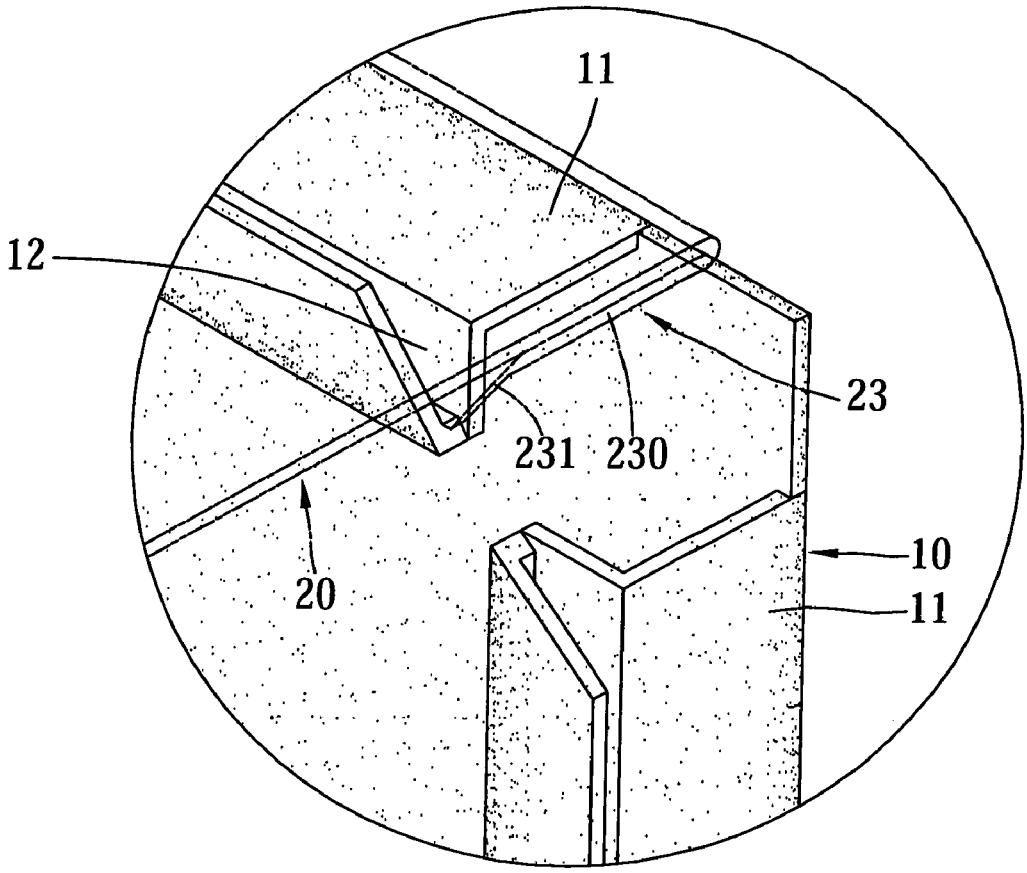
FIG. 3 is an enlarged partial view of a first reinforcement device for use in the combinative locker of FIG. 1.
Figure 4:
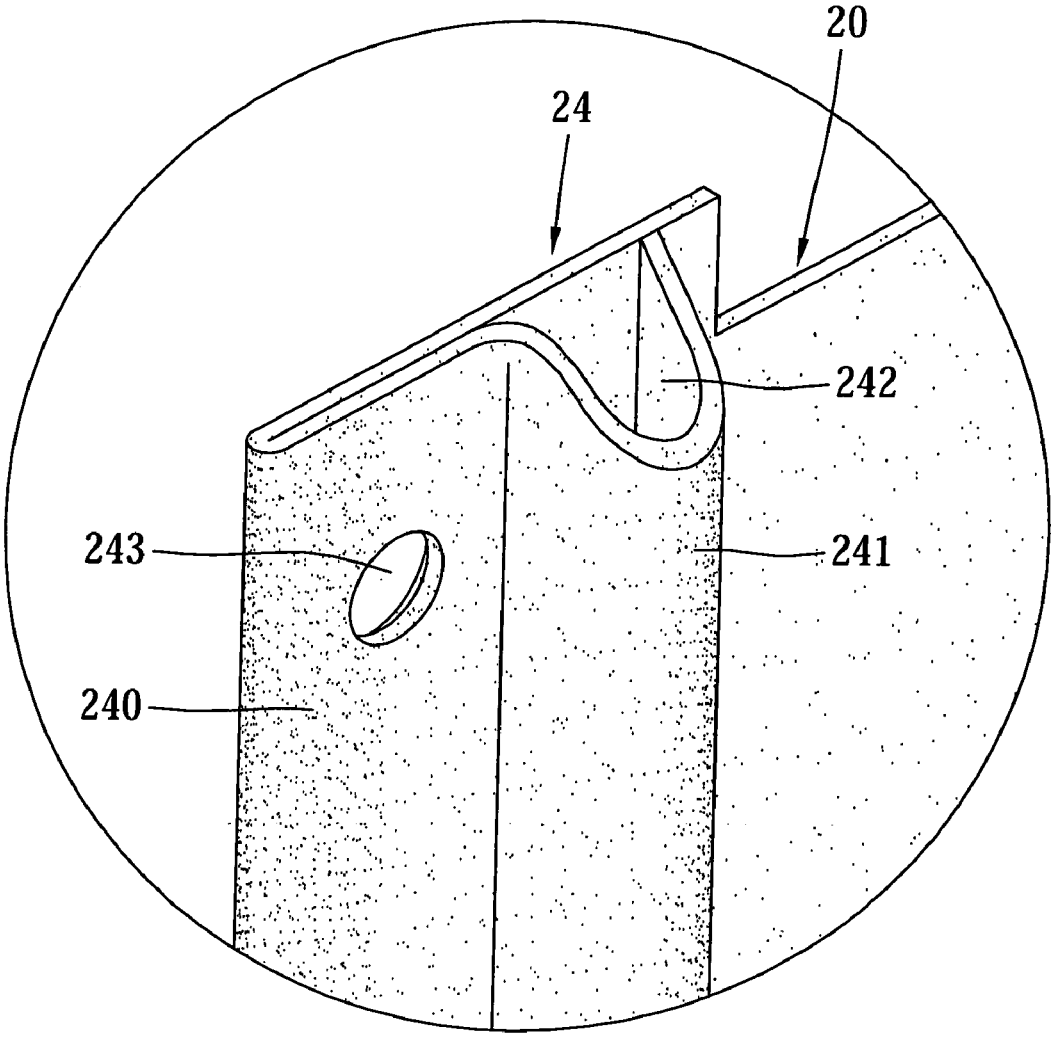
FIG. 4 is an enlarged partial view of a second reinforcement device for use in the combinative locker of FIG. 1.

Each peripheral panel 20 includes a rear edge, two lateral edges and a front edge. Referring to FIG. 3, a reinforcement device 23 is formed at the rear edge of each peripheral panel 20. A plurality of tubes 22 is formed at each lateral edge of each peripheral panel 20. Referring to FIG. 4, a reinforcement device 24 is formed at the front edge of each peripheral panel 20. Each peripheral panel 20 defines a plurality of apertures 25.

The reinforcement device 23 includes a strip 230 extending in parallel to each peripheral panel 20 and a fin 231 extending from the strip 230 at an angle. The reinforcement device 23 is preferably a retroflexed edge of each peripheral panel 20.

The reinforcement device 24 includes a strip 240 extending in parallel to each peripheral panel 20 and a corrugated member 241 integrated with the strip 240. Each peripheral panel 20 and its the corrugated member 241 together define a channel 242. The reinforcement device 24 is preferably a retroflexed edge of each peripheral panel 20.

Four L-shaped connectors 31 and four shafts 30 are used to connect the peripheral panels 20 with one another and keep them in position.

Figure 5:
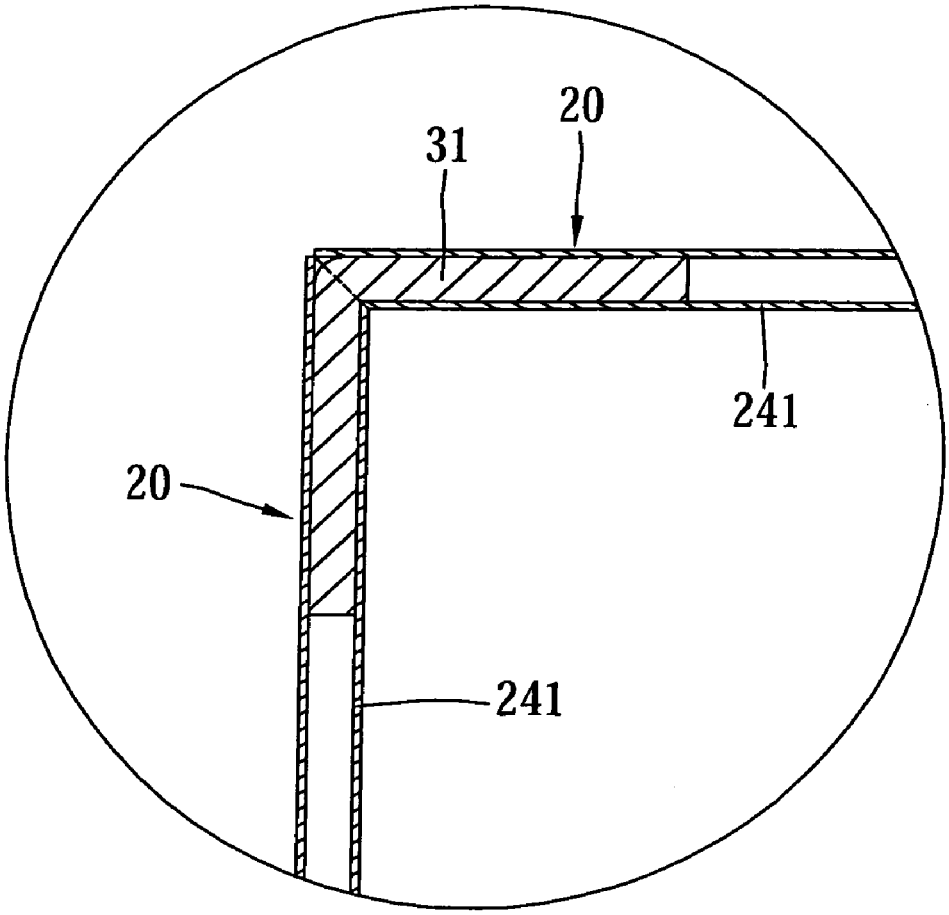
FIG. 5 is a cross-sectional partial view of the combinative locker of FIG. 1.
Figure 6:
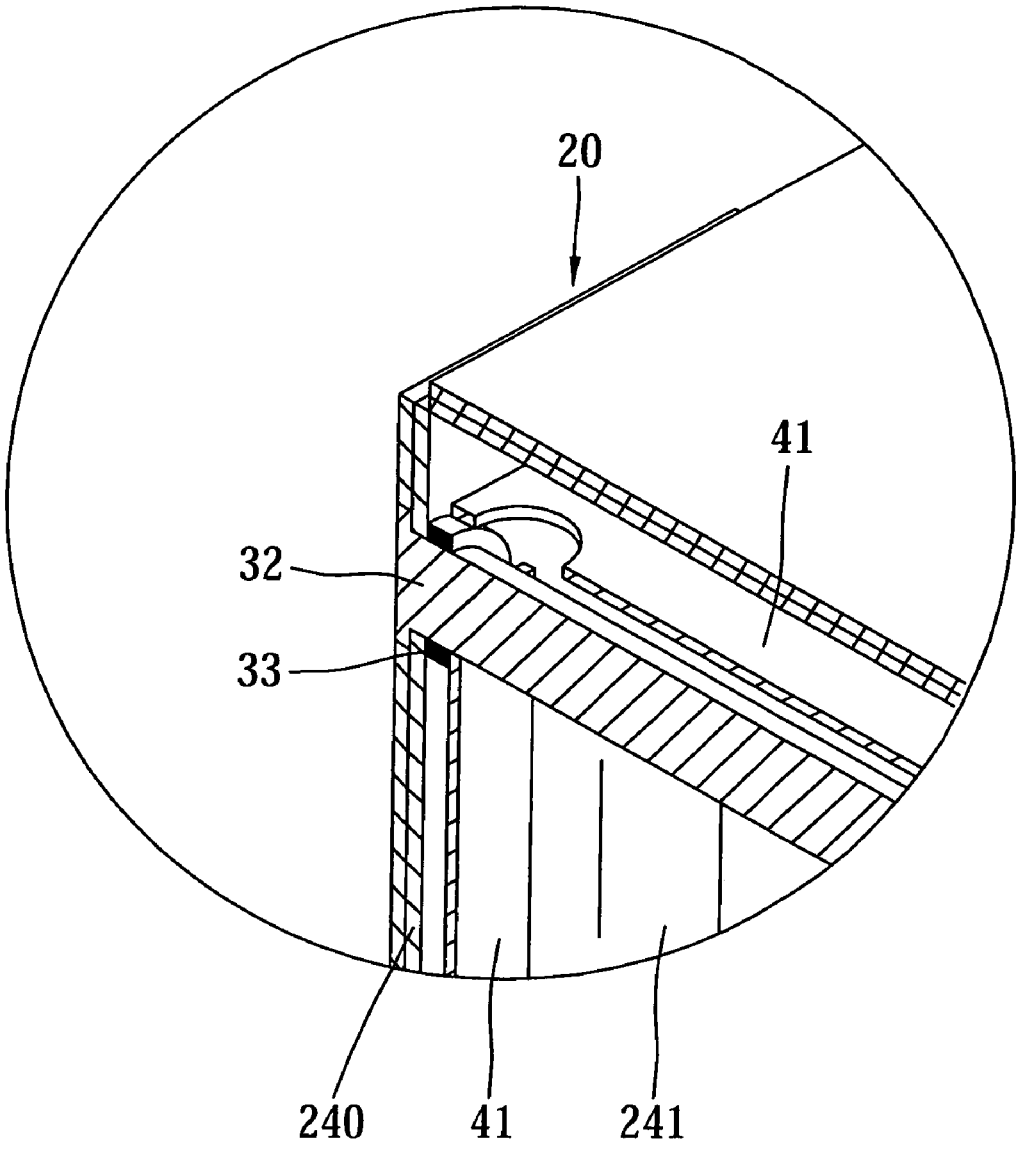
FIG. 6 is a cutaway view of the combinative locker of FIG. 1.

Referring to FIG. 5, each connector 31 includes an end fit in the channel 242 of one peripheral panel 20 and another end fit in the channel 242 of another peripheral panel 20. Three peripheral panels 20 are connected with one another by two L-shaped connectors 31 before the rear panel 10 is attached to them. Three grooves 12 receive the fins 231 of these peripheral panels 20, respectively. The last peripheral panel 20 is connected with two previous peripheral panels 20 by two L-shaped connectors 31.

Each shaft 30 is inserted in the tubes 22 formed at one lateral edge of one peripheral panel 20 and the tubes 22 formed at one lateral edge of another peripheral panel 20. Two washers 33 are mounted on one of the shafts 30.

The shutter 40 includes four edges. A fin 41 extends perpendicularly from each edge of the shutter 40. A tube 42 is attached to a fin 41. Two opposite fins 41 both define an aperture 44. The tube 42 is aligned with the apertures 44. A knob 43 is attached to the shutter 40 for facilitating operation of the shutter 40. The shutter 40 is confined between the washers 33 so that it will not strike two vertical peripheral panels 20.

Two shafts 32 are used to pivotally connect the shutter 40 with a peripheral panel 20. Each shaft 32 is inserted through a hole 243 defined in the front edge of a peripheral panel 20 and an aperture 44, and fit in a tube 42.

A board 50 is installed in the locker by four pairs of pins 51 and caps 52. Each pin 51 is installed into the interior of the locker through one of the apertures 25 in one of the vertical peripheral panels 20 with an enlarged head thereof left in the extension of the locker. Each cap 52 is put on one of the pins 51. Thus, the pairs of pins 51 and caps 52 are firmly attached to the vertical peripheral panels 20 in order to support the board 50.

The present invention has been described via detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A combinative locker including:

a plurality of peripheral panels connected with one another, each of the peripheral panels including an internal side, a rear edge, a front edge, a first reinforcement device formed on the internal side at the rear edge and a second reinforcement device formed on the internal side at the front edge, wherein the first reinforcement device includes a retroflexed strip extending from the rear edge of each of the peripheral panels;

a rear panel including a plurality of edges each connected with the rear edge of one of the peripheral panels, wherein the rear panel includes four fins each extending perpendicularly from one of the edges thereof, wherein the first reinforcement device of each of the peripheral panels is in contact with one of the fins of the rear panel, wherein each of the fins of the rear panel includes a corrugated edge defining a groove, and the first reinforcement device of each of the peripheral panels includes a fin put in one of the grooves; and a front panel including a plurality of edges, wherein one of the plurality of edges of the front panel is pivotally connected with the front edge of one of the peripheral panels.

2. The combinative locker according to claim 1 wherein the retroflexed strip substantially extends in parallel to each of the peripheral panels.

3. The combinative locker according to claim 1 wherein the second reinforcement device includes a retroflexed strip extending from the front edge of each of the peripheral panels.

4. The combinative locker according to claim 3 wherein the retroflexed strip substantially extends in parallel to each of the peripheral panels.

5. The combinative locker according to claim 3 wherein the second reinforcement device includes a corrugated member defining a space between itself and each of the peripheral panels for receiving an end of an L-shaped connector.

* * * * *